US008769875B1

(12) United States Patent
Scoggins

(10) Patent No.: US 8,769,875 B1
(45) Date of Patent: Jul. 8, 2014

(54) THRESHOLD AND LAG ASSEMBLY FOR A DOOR

(76) Inventor: Tommy G. Scoggins, Burlington, NC (US)

( * ) Notice: Subject to any disclaimer, the term of this patent is extended or adjusted under 35 U.S.C. 154(b) by 71 days.

(21) Appl. No.: 13/159,644

(22) Filed: Jun. 14, 2011

(51) Int. Cl.
*E06B 1/70* (2006.01)

(52) U.S. Cl.
USPC ..... 49/467

(58) Field of Classification Search
USPC ..... 49/197, 199, 467–471; 52/211, 836, 52/846
See application file for complete search history.

(56) References Cited

U.S. PATENT DOCUMENTS

| | | | | | |
|---|---|---|---|---|---|
| 2,572,154 | A | | 10/1951 | Howard | 20/64 |
| 3,148,419 | A | * | 9/1964 | Straus et al. | 49/469 |
| 3,654,730 | A | | 4/1972 | Fraleigh | 49/34 |
| 3,762,100 | A | * | 10/1973 | Kempel | 49/468 |
| 4,074,464 | A | * | 2/1978 | McCay | 49/468 |
| 4,104,830 | A | * | 8/1978 | Eagle | 49/468 |
| 4,387,535 | A | * | 6/1983 | Corbo | 49/468 |
| 4,565,033 | A | * | 1/1986 | Tinfow | 49/468 |
| 5,584,157 | A | * | 12/1996 | Sun | 52/656.4 |
| 5,673,517 | A | * | 10/1997 | Stanclift | 49/468 |
| 6,061,967 | A | * | 5/2000 | Judds | 49/469 |
| 6,286,263 | B1 | * | 9/2001 | Burrill | 49/472 |
| 6,295,763 | B1 | | 10/2001 | Serba | 49/468 |
| 7,694,471 | B2 | * | 4/2010 | Meeks et al. | 52/207 |
| 8,186,114 | B2 | * | 5/2012 | Rissone | 52/211 |
| 2004/0200153 | A1 | * | 10/2004 | Khanlarian | 49/468 |
| 2006/0123721 | A1 | * | 6/2006 | Rissone | 52/211 |
| 2008/0148645 | A1 | * | 6/2008 | Rissone | 49/468 |

* cited by examiner

*Primary Examiner* — Katherine Mitchell
*Assistant Examiner* — Scott Denion
(74) *Attorney, Agent, or Firm* — Blake P. Hurt

(57) ABSTRACT

Garages and other large buildings having wide overhead doors are subject to increased maintenance and cleaning as a result of the unwanted entry of moisture, dead leaves and other debris which are often blown along the surface of the yard or driveway and into the door opening. A rigid threshold section with a pair of flanges is directly mounted below using a lag assembly and receives the overhead door therein to block and deter leaves and other debris from entering the opening when the door is being opened or closed. Cars and other vehicles can drive over the threshold section without difficulty or damage thereto due to its shape and rigidity. Multiple threshold sections can be joined to form a threshold of sufficient length for a particular door width in either a permanent or temporary manner.

19 Claims, 8 Drawing Sheets

THRESHOLD AND LAG ASSEMBLY FOR A DOOR

FIELD OF THE INVENTION

The invention herein pertains to thresholds for doors and particularly pertains to threshold and lag assemblies for large outside overhead doors as are used in garages and other buildings. The purpose of the threshold and lag is to provide a impenetrable barrier between the bottom of the overhead door and the substrate to prevent moisture, leaves and other surface debris from being blown or drawn through the door opening.

DESCRIPTION OF THE PRIOR ART AND OBJECTIVES OF THE INVENTION

Frequent cleaning and maintenance is required inside most garages having overhead doors which are frequently opened and closed. Leaves, dirt and other surface type debris often collect against the closed garage door, only to have the debris drawn into the garage once the door is opened. A typical home or business owner after removing a vehicle from the garage has to sweep or vacuum the garage before returning the vehicle due to debris entry during vehicle movement. Further a gap typically exists between a closed garage door and the floor or other substrate allowing moisture, dirt and debris to enter the garage or building.

Various attempts have been made in the past to prevent entry of surface debris such as set forth in U.S. Pat. Nos. 2,572,154 and 3,654,730. While these attempts have been somewhat successful certain shortcomings and disadvantages have also been apparent. For example in U.S. Pat. No. 3,654,730 the flexible nature of the threshold allows debris to enter as the weight of a car causes the threshold to bend and collapse. Other prior art thresholds are difficult to assemble and install and have insufficient height to stop low-flying or surface debris.

Thus, in view of the problems and disadvantages associated with prior art devices, the present invention was conceived and one of its objectives is to provide a durable, rigid threshold and lag assembly and installation method for an overhead door in which the threshold remains upright and is not distorted as a vehicle is driven across.

It is another objective of the present invention to provide a threshold assembly for an overhead door which will tightly fit the bottom of the door to prevent water and debris entry when the door is closed.

It is still another objective of the present invention to provide a threshold and lag assembly and method of installation for an exterior door opening which will stop leaves and other low flying or surface debris from entering and which will secure the threshold to the floor or other substrate.

It is yet another objective of the present invention to provide a threshold which is formed in sections and is easily installed using a lag assembly regardless of the width of the door opening.

It is a further objective of the present invention to provide a threshold and lag assembly which is inexpensive to manufacture, sell and purchase.

It is still a further objective of the present invention to provide a rigid threshold formed in sections for easy installation or removal.

It is yet a further objective of the present invention to provide a threshold formed from a series of U-shaped sections which can be quickly installed in a temporary or permanent manner with a lag assembly having a sleeve, bushing and lag bolt.

Various other objectives and advantages of the present invention will become apparent to those skilled in the art as a more detailed description is set forth below.

SUMMARY OF THE INVENTION

The aforesaid and other objectives are realized by providing a threshold and lag assembly for an overhead door in which the threshold is formed from U-shaped sections, each section including a pair of opposing flanges extending downwardly and outwardly therefrom. The threshold can be installed using sections sized to fit a particular door width which may be eight, nine, ten, twelve, eighteen, or more feet as conventional. Each threshold section is preferably formed from fourteen (14) gauge steel using conventional forming techniques. The threshold sections can be powder coated, painted, varnished, plated or otherwise coated by conventional techniques. Suitable polymeric materials may also be used as desired. Each threshold section includes an elongated U-shaped member having opposing flanges which extend at an angle outwardly therefrom. The flanges are of a width shorter than the height of the threshold sections to provide an area therebeneath for repelling leaves and other like debris. A flexible seal extends the base length of each threshold section to form a seal against moisture and debris entry between the threshold and substrate. The ends of each section can be formed to interlock during assembly and having threshold end sections with cutouts to avoid interference with overhead door tracks. Lag bolts or other known fasteners with anchors can be used to secure the threshold sections in place on a substrate such as a concrete floor. Once installed the threshold, due in part to its height, will prevent surface debris such as dead leaves or grass clippings from being drawn into the opening when the door is raised. Such debris is trapped and/or repelled by each section in the area between the flange and the floor or substrate. Further, when the overhead door is closed, the bottom thereof is received within the U-shaped member and together with the seal therebeneath the threshold provides an impenetrable barrier to also assist in keeping out rain, snow and the like during adverse weather conditions. The rigidity of the threshold sections prevent damage or movement as a plurality of polygon shaped braces are attached beneath the flanges to the sides of the U-shaped member for increased structural integrity. Various manufacturing techniques can be used to form each threshold section such as molding, bending or extruding, depending on the particular material selected. Threshold blank sections can be manufactured of suitable length and thereafter the ends cut or formed for a particular installation. The lag assembly is placed through preformed apertures in the U-shaped members for securement to the substrate. The lag assembly includes a lag bolt, bushing and sleeve and securely maintains the threshold in place under adverse conditions. For temporary installations the lag bolt is usually not required.

DETAILED DESCRIPTION OF THE PREFERRED EMBODIMENT AND OPERATION OF THE INVENTION

Figure 1:
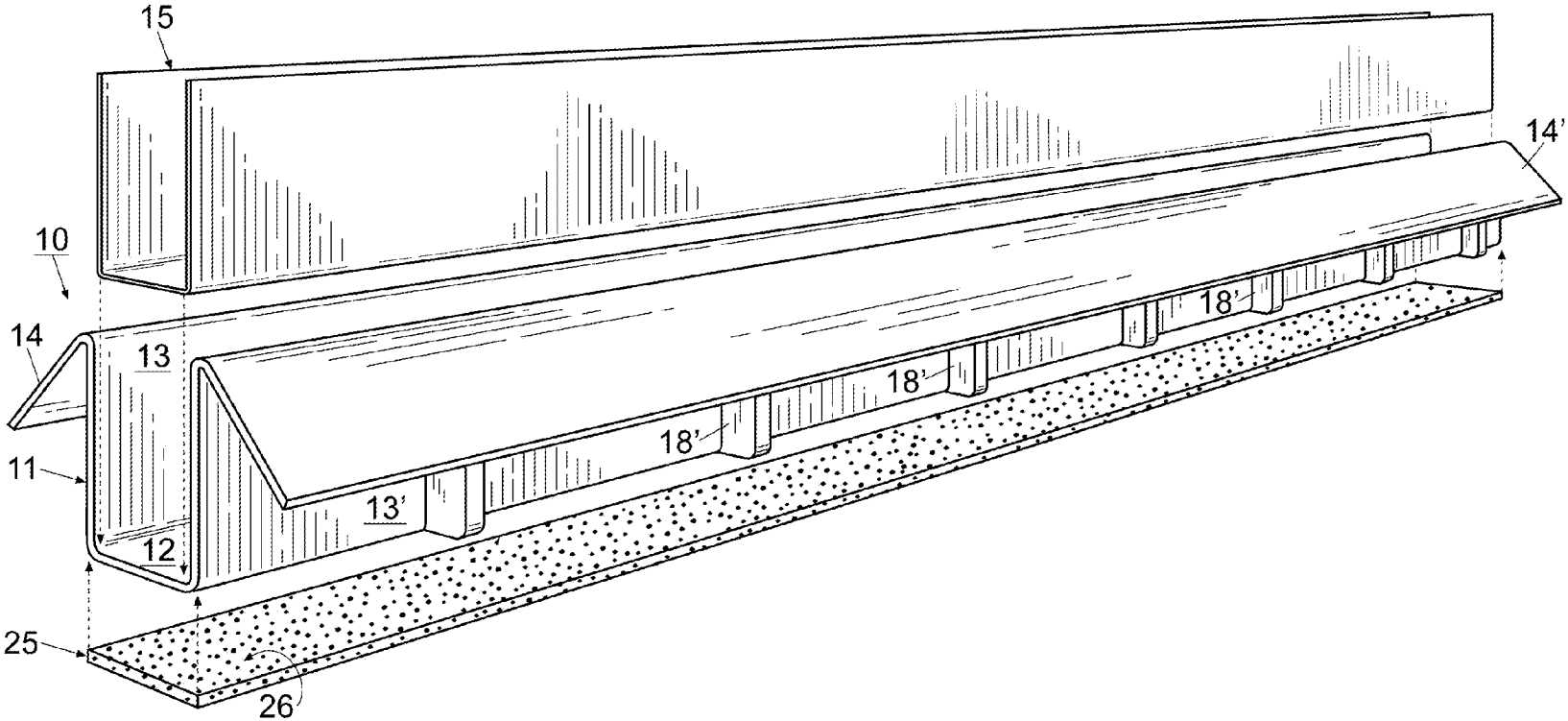
FIG. 1 illustrates a top, end, left side perspective view of a blank threshold section with a seal and liner exploded therefrom.
Figure 5:
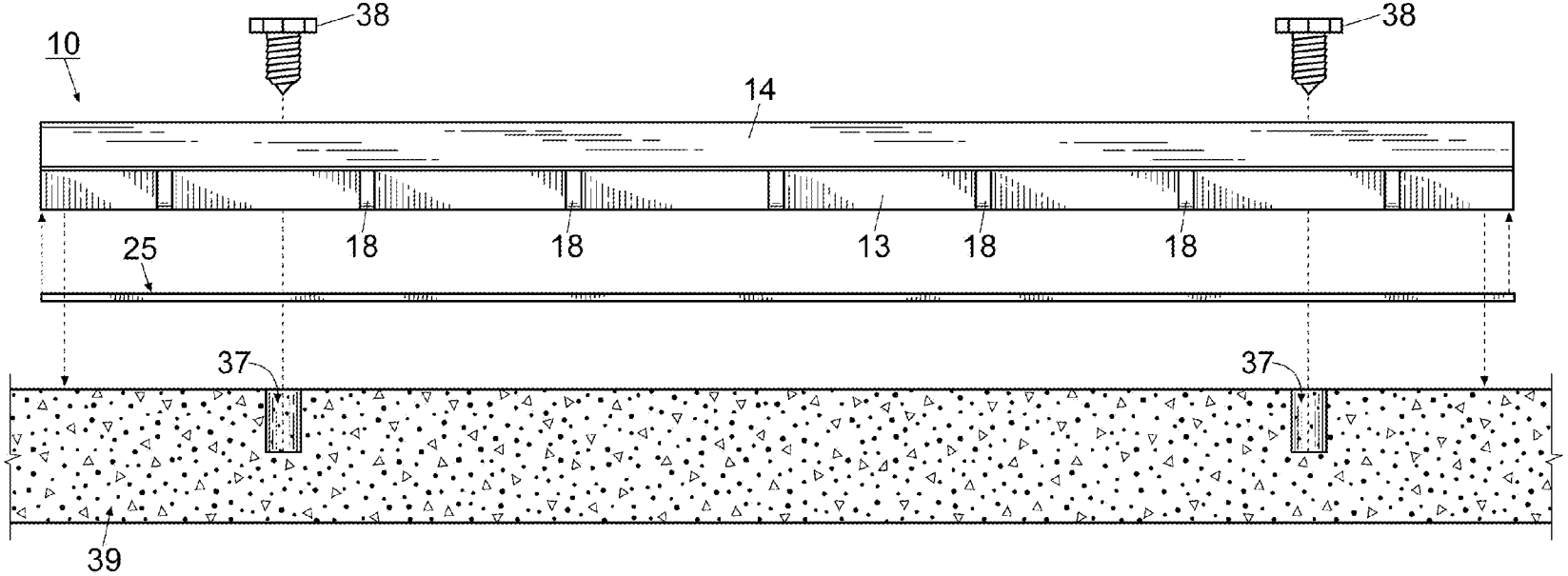
FIG. 5 demonstrates a right side elevational view of the threshold section as seen in FIG. 1 prior to attachment to a substrate, the left side elevational view of the threshold section being a mirror image thereof.
Figure 8:
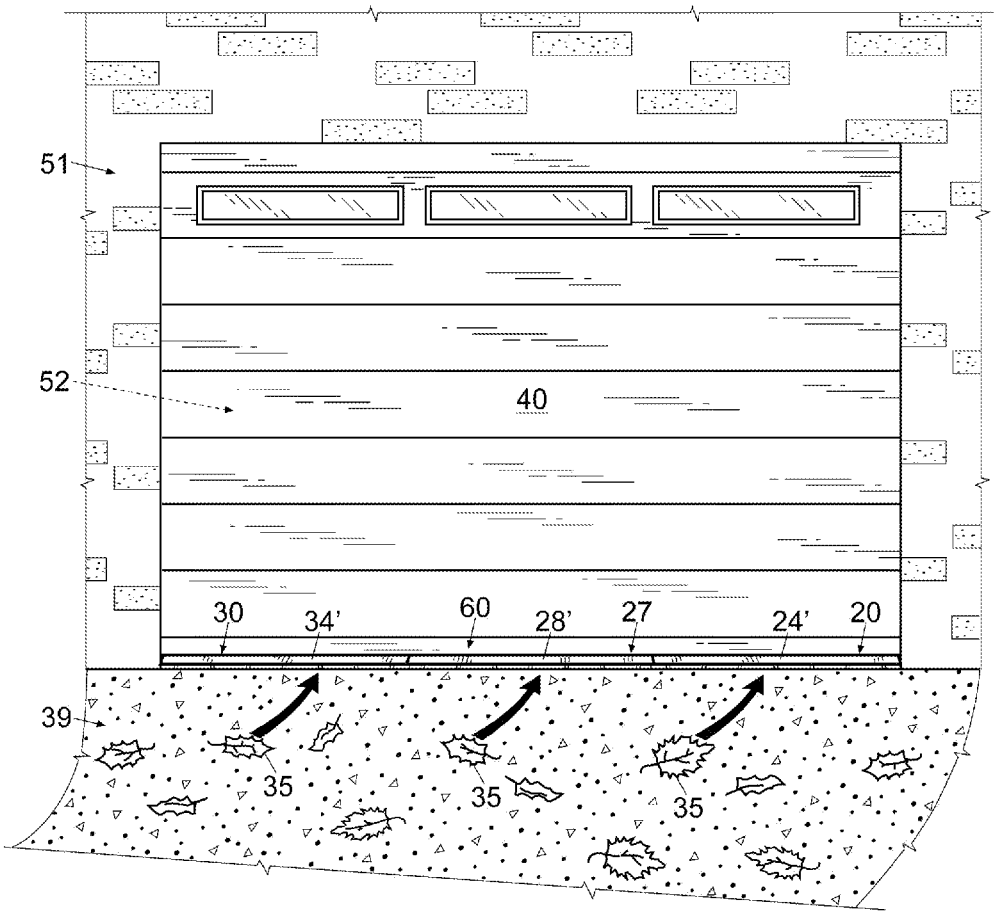
FIG. 8 shows an installed threshold assembly using three threshold sections on the floor in a garage door opening with the overhead garage door closed and contained in the threshold assembly.

For a better understanding of the invention and its operation, turning now to the drawings, FIG. 1 demonstrates preferred blank threshold section 10 with optional liner 15 and seal 25 and is further shown in alternate views in FIGS. 2, 3, 4 and 5. Preferred blank threshold section 10 provides a tight, impenetrable protective barrier between an overhead door such as an overhead garage door and the substrate therebeneath which may be a concrete garage floor by utilizing seal 25. Section 10 includes an elongated U-shaped member 11 of preferably, approximately thirty-six (36) inches (91.4 cm) in length although other lengths may be manufactured as desired. U-shaped member 11 includes planar horizontal base 12 of about one and one-half (1½) inches (3.81 cm) in width with opposing, spaced parallel vertical sides 13, 13', each with a height of approximately two (2) inches (5.08 cm) attached thereto forming open channel 33 therebetween. Downwardly depending flanges 14, 14' are affixed respectively to the top of sides 13, 13' and have a width of approximately one and three quarter (1¾) inches (4.45 cm) each. Base 12 includes apertures 16, 16' therein for receiving fasteners to affix the threshold sections to a substrate as shown in FIGS. 5 and 8. Blank threshold section 10 may be integrally formed as by molding, bending, extruding or other conventional metal forming techniques and is preferably formed from fourteen (14) gauge steel which may be plated, powder coated in various colors or other standard suitable coating processes can be used.

Figure 2:
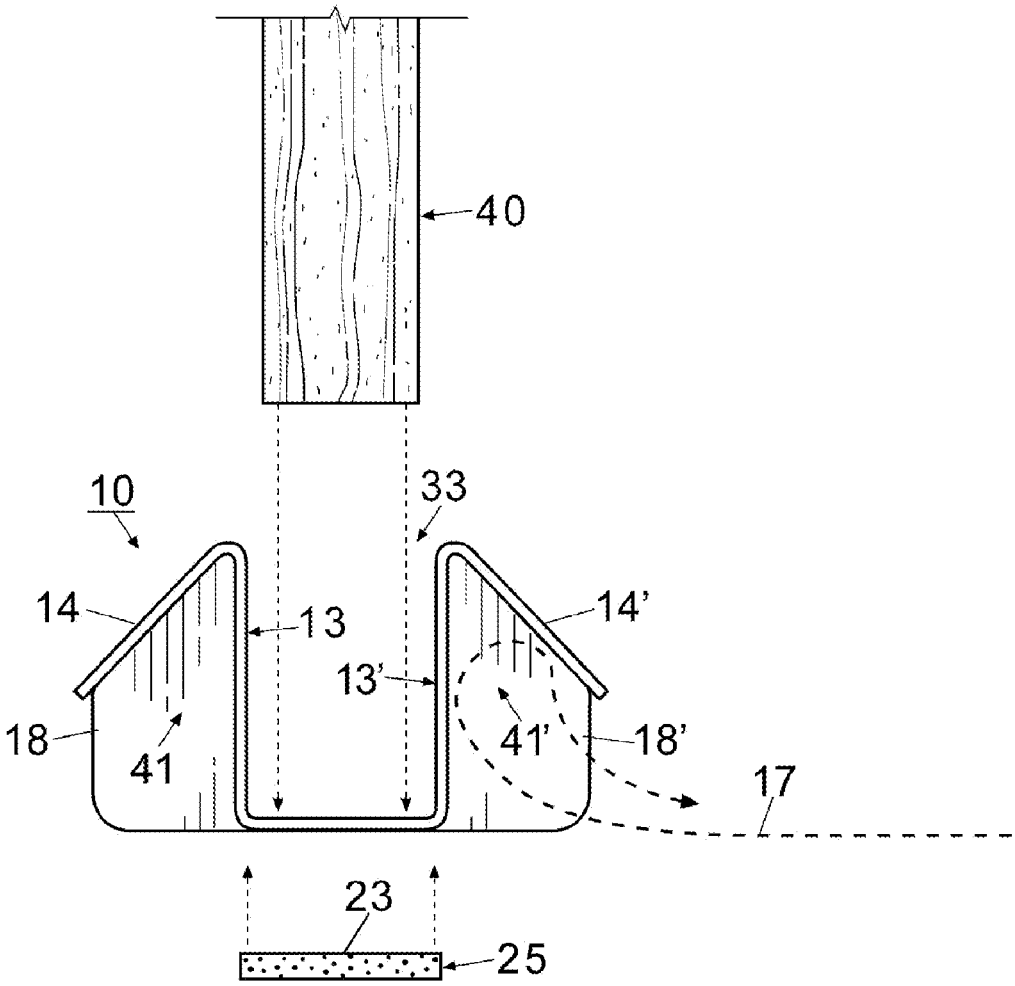
FIG. 2 pictures an enlarged end view of the threshold section as seen in FIG. 1 with a partial garage door prior to closure and with an exploded seal for attachment to the bottom thereof, the opposite end view of the threshold section being a mirror image thereof.
Figure 3:
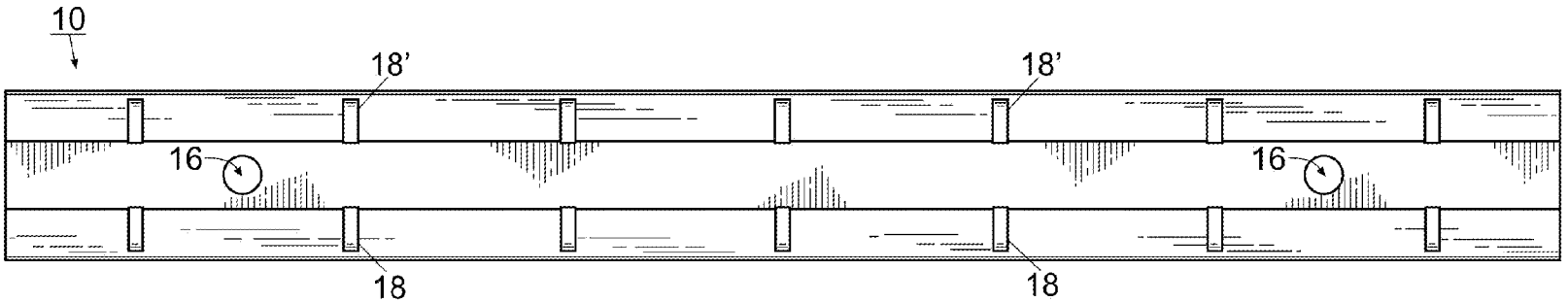
FIG. 3 shows a bottom plan view of the threshold section as seen in FIG. 1.
Figure 4:
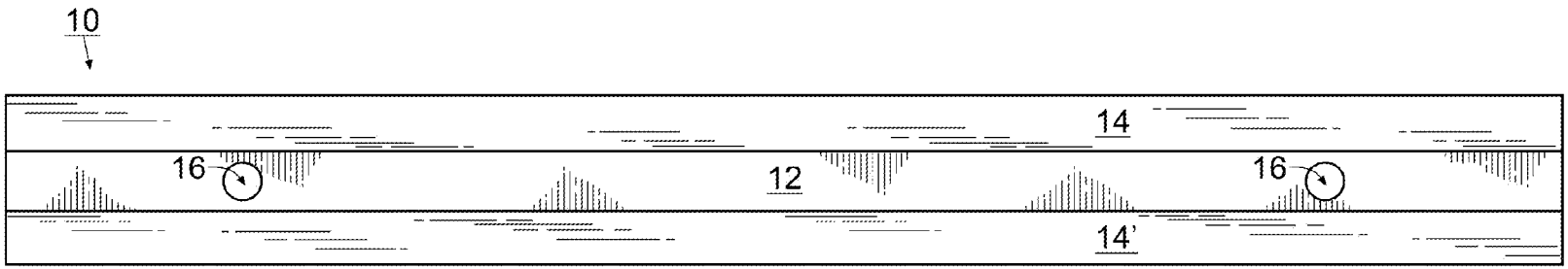
FIG. 4 depicts a top plan view of the threshold section as seen in FIG. 1.

Blank threshold section 10 includes a plurality of polygon shaped flange braces 18, 18' as seen in FIGS. 1, 2, 3 and 5 spaced along of exterior surfaces 57, 57' (FIG. 9) of respectively sides 13, 13'. Braces 18, 18' have four (4) sides and support and maintain flanges 14, 14' respectively at an outwardly extending angle of approximately 30-60°, preferably 40°, from sides 13, 13' as seen in FIG. 2. In doing so, flanges 14, 14' define cavities 41, 41' which are shaped to urge wind away from threshold 10 as shown in FIG. 2. Although not shown, this action also permits wind 17 to remove debris away from threshold 10 on its return trip, regardless of whether the air flow is on the interior or exterior side of door 40. Braces 18, 18' are rigidly joined respectively such as by welding to sides 13, 13' and preferably contiguous (and not rigidly affixed) to flanges 14, 14' for added integrity to blank threshold section 10. By utilizing braces 18, 18' threshold section 10 has sufficient structural integrity to withstand a vehicle such as a car passing repeatedly thereover without damage or distortion thereto.

Figure 6:
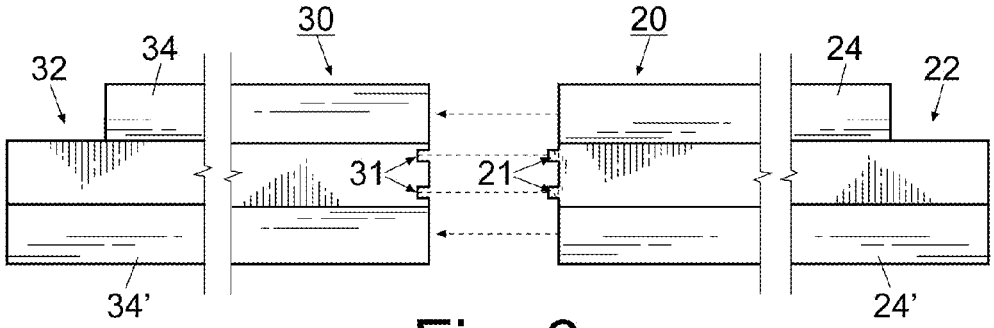
FIG. 6 illustrates a pair of alternate configurations of the ends of partial threshold sections prior to engagement.
Figure 7:
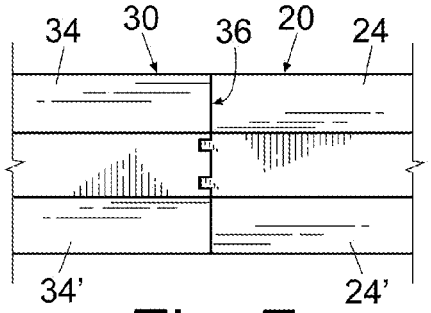
FIG. 7 depicts the alternate threshold sections of FIG. 6 engaged.

Threshold section 10 may also be formed from polymeric or other suitable rigid materials. While preferred threshold section 10 is shown as a blank section, the ends can be alternatively formed as seen in FIGS. 6 and 7 in threshold sections 20 and 30. Threshold section 20 includes teeth 21 on one end with cutout 22 on the opposite end and opposing flanges 24, 24' while threshold section 30 includes notches 31 on one end with cutout 32 on the opposite end and opposing flanges 34, 34'. When joined, teeth 21 of threshold section 20 are received within notches 31 of threshold section 30 as seen in FIG. 7 to form seamless joint 36. As would be understood the threshold sections can be formed having different combinations of blank ends, teeth, notches, cutouts or otherwise for forming various length threshold assemblies, such as a threshold assembly 60 pictured in FIG. 8 for a particular door width. Threshold sections 20, 27 and 30 having different ends are formed similar to blank threshold section 10, whereby each section includes an elongated U-shaped member with a base having apertures therein and opposing, spaced parallel vertical sides with downwardly depending flanges and a plurality of polygon shaped flange braces. Thereafter, the ends are shaped for a particular threshold configuration.

As also seen in FIG. 1, U-shaped member 11 has a preferred internal width of about one and one half (1½) inches (3.81 cm) for accepting a conventional overhead door between vertical sides 13, 13'. Liner 15 as seen in FIG. 1 can be formed in various thicknesses, from a usual polyurethane. When used with thin garage doors, the thickness of liner 15 is chosen to insure a tight fit between the garage door and the threshold section. Liner 15 is adhered with a standard adhesive (not shown) to the inside of U-shaped member 11 during threshold assembly installation for a water tight fit. Holes coincidental to apertures 16 can be manually placed in liner 15 as needed.

During installation of threshold 60 (FIG. 8), seal 25 as seen in FIGS. 2 and 5 is adhesively affixed (not shown) to the bottom of each threshold section for added barrier protection from outside water, dirt, debris, leaves or the like. Seal 25 is preferably resilient member 23 formed from a high density polymeric or other foam and includes an adhesive coating 26 only on the upper surface to insure stable placement. Seal 25 is approximately the same width as base 12 (FIG. 2) and provides a water tight seal as adhesive surface 26 adheres seal 25 to the bottom of base 12. Once seal 25 is affixed, if needed a knife blade or other tool (not shown) can be utilized to cut holes (not shown) in seal 25 corresponding to apertures 16 (FIG. 1) for placement of, for example standard lag bolts 38 (FIG. 5) therethrough.

In FIG. 5 blank threshold section 10 is positioned over concrete floor 39 with seal 25 therebetween. Lag bolts 38 are conventional and engage pre-drilled holes (not shown) in concrete floor 39. Lag bolts 38 pass through apertures 16 (FIGS. 1, 3 and 4) and seal 25 for secure attachment, for example of blank threshold section 10 to concrete floor 39 using conventional lag bolt sleeves 37 positioned in pre-drilled holes in floor 39. As would be understood, blank threshold section 10 or alternate sections can be removed by first extracting lag bolts 38.

FIG. 6 demonstrates a top view of abbreviated threshold section 20 having teeth 21 which mate with corresponding notches 31 of threshold section 30 to form seamless joint 36 as shown in FIG. 7 between alternate threshold section 20 and alternate threshold section 30. Threshold sections 20 and 30 also may include respectively cutouts 22, 32 for allowance of conventional garage door tracks (not shown) mounted inside garage opening 52. Another alternate threshold section, threshold section 27 has opposing flanges 28, 28' (28 not shown) (FIG. 8) and includes teeth 21 on one end and notches 31 on the opposite end to fit between and engage both threshold sections 20 and 30 as in threshold 60. By forming threshold sections having corresponding teeth and notches, many threshold sections can be joined together to form a stable, seamless threshold of desired length, for example, eight (8), nine (9), ten (10), sixteen (16), eighteen (18) feet or longer for suitable thresholds for garage or other overhead doors. Some threshold sections may employ ends with alternate teeth or notches, or having ends with a pair of notches or teeth alone (not seen) and with or without rail cutouts 22, 32 as pictured in FIG. 6. As would be understood, thresholds can be formed by simply abutting and securing blank threshold sections without end notches or teeth, but such is not preferred.

As known, surface leaves 35 shown in FIG. 8, dust and debris can easily be blown or drawn into garage 51 during overhead garage door 40 opening or closing. However, threshold assembly 60 formed by joining three (3) threshold sections completely traverses garage door opening 52 to provide an impenetrable barrier against such surface debris and water penetration such as during adverse weather conditions.

Garage door 40 is received between sides 13, 13' of blank threshold section 10 as seen in FIG. 2. In FIG. 8, threshold assembly 60 blocks surface leaf entry and allows leaves 35 and other debris to be collected beneath flanges 24', 28' and 34' of respectively sections 20, 27 and 30. Further, wind blowing against threshold assembly 60 causes a swirling action beneath flanges 24', 28' and 34' causing leaves 35 and other trapped debris therebeneath to be blown away or repelled such as shown by dashed arrow line 17 in FIG. 2, aiding in the prevention of debris entry into garage 51.

Figure 9:
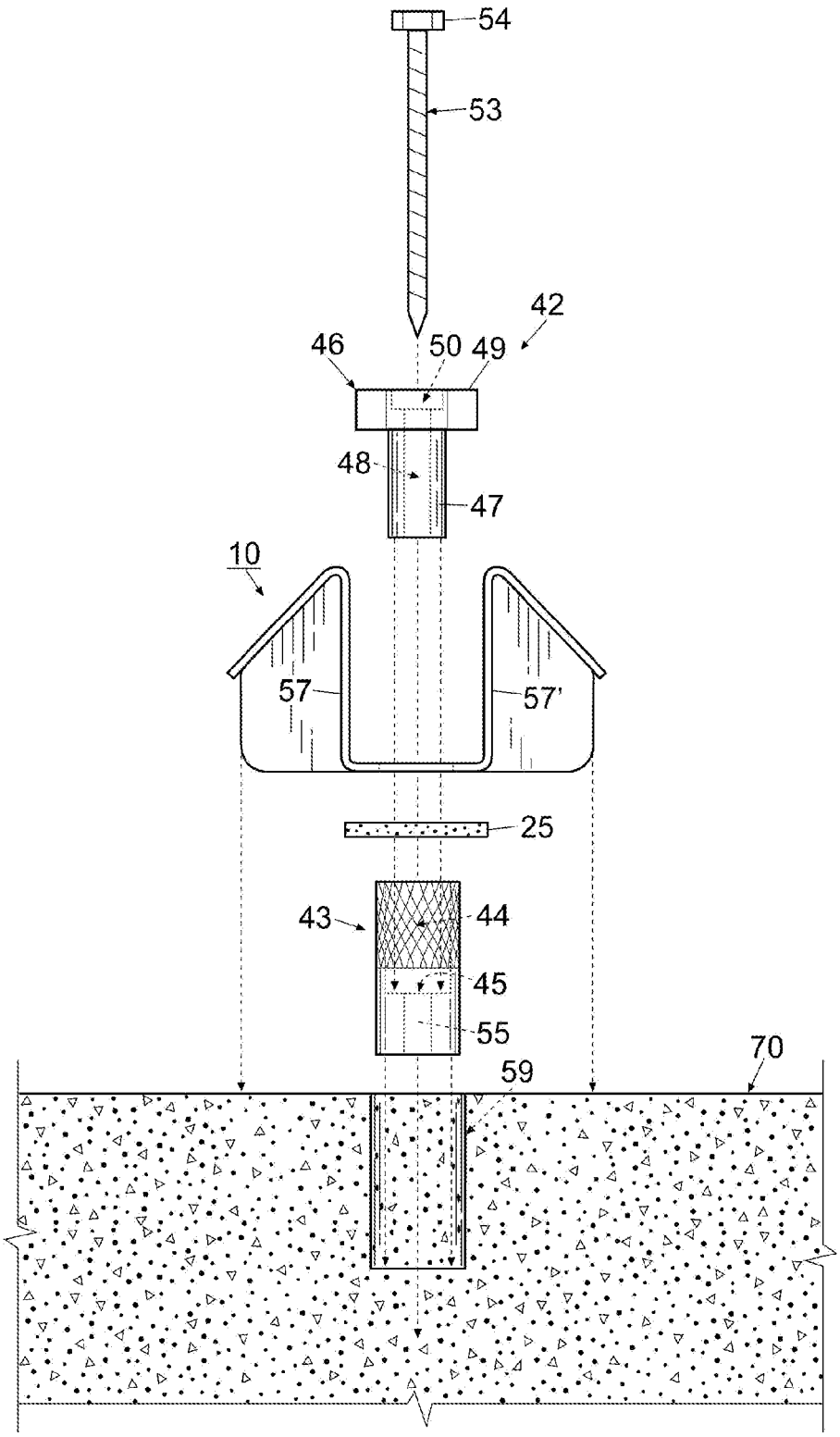
FIG. 9 features an enlarged exploded end view of a threshold section and lag assembly prior to installation on a substrate.
Figure 10:
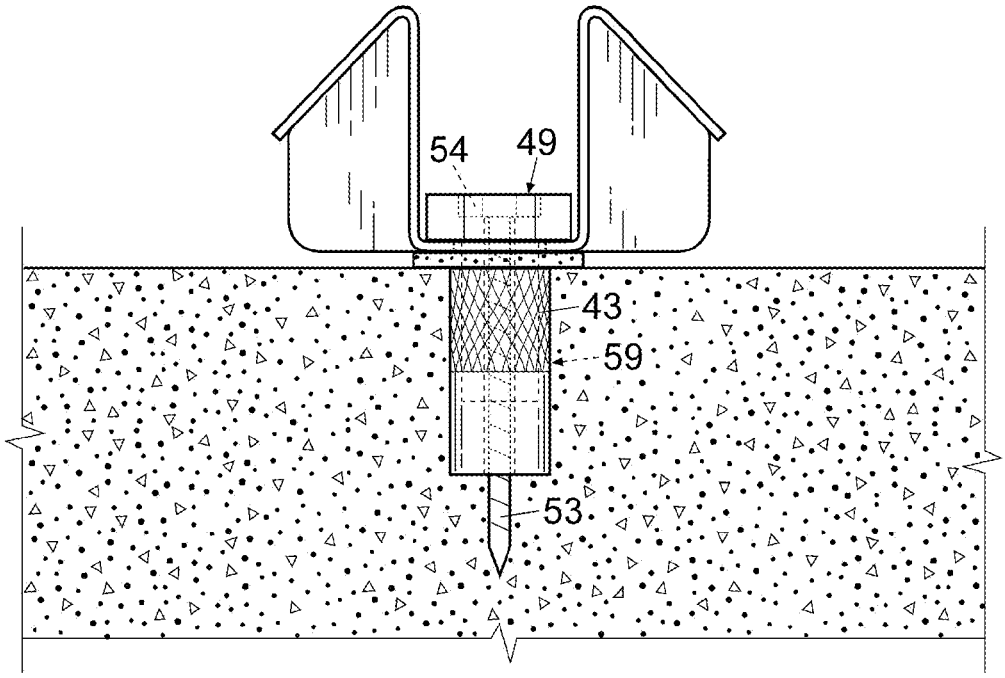
FIG. 10 pictures the threshold section of FIG. 9 as installed with the lag assembly in a substrate.
Figure 11:
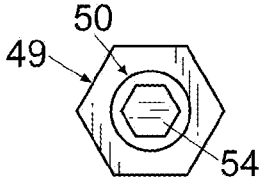
FIG. 11 shows a top view only of the lag assembly as seen in FIG. 10.

In FIGS. 9, 10 and 11 preferred lag assembly 42 is shown in exploded fashion with blank threshold section 10 and substrate 70 which may be a concrete garage floor or the like. Lag assembly 42 includes lag bolt 53 having head 54, bushing 46 and knurled lag bolt sleeve 43 which acts as an anchor. Bushing 46 includes head 49 having recess 50 therein and body 47 with a central channel 48 extending therethrough for receiving lag bolt 53. Knurled lag bolt sleeve 43 includes a large central bore 44, an internal shoulder 45 for receiving bushing 46 and a smaller duct 55 for receiving lag bolt 53. Bore 44 has a sufficient diameter to receive cylindrical bushing body 47 of bushing 46 while duct 55 is of a sufficient diameter to receive lag bolt 53. Bushing head 49 also seen in FIGS. 10 and 11 includes recess 50 to allow head 54 of lag bolt 53 to fit flush therein as shown in FIG. 10. Recess 50 is of sufficient width to allow a standard socket wrench to fit over lag bolt head 54 therewithin while installing or removing lag bolt 53.

The preferred method of installing a threshold of the invention includes the steps of selecting threshold sections such as sections 10, 20, 27 or 30 for a typical nine foot garage door opening, for example garage opening 52 seen in FIG. 8. The installer (not shown) drills holes 59 of sufficient size to accommodate preferred lag bolt sleeves 43 in concrete floor 70 (FIGS. 9 and 10) for alignment with apertures 16 in blank threshold section 10 or otherwise. Lag bolt sleeves 43 are then positioned within pre-drilled holes 59 as seen in FIGS. 9 and 10. Next, a seal 25 is affixed to the bottom of the base of each threshold section as needed which is then positioned on substrate 70 with apertures 16 aligned with holes 59 so bushings 46 and lag bolts 53 can be placed through apertures 16 and seal 25 and into lag bolt sleeves 43. Bushings 46 are then slid through apertures 16 and seal 25 and into sleeves 43 with blank threshold section 10 therebetween as shown in FIG. 10. Once bushing 46 is securely seated on shoulder 45 of sleeve 43, lag bolt 53 is then inserted through recess 50 into channel 48 of bushing 46 and through small diameter duct 55 at the lower end of bore 44 in sleeve 43. A socket wrench or power tool can then be used to drive lag bolt 53 into concrete substrate 70 beyond sleeve 43. Once lag bolt 53 is firmly secured to substrate 70, lag bolt head 54 is within recess 50 and flush with bushing head 49 as seen in FIG. 10. When the overhead door is closed and received within threshold section 10 together with seal 25 rigidly held in place by lag assembly 42 an impenetrable barrier against moisture, surface debris, leaves and the like is provided.

If the threshold such as threshold 60 in FIG. 8 is only needed as a temporary debris stop, lag bolt 53 can be withdrawn or not used in the installation. In such cases, threshold 60 can be easily partially or completely removed by extracting bushings 46 from each threshold section, and the threshold sections simply lifted from substrate 70 as seen in FIG. 10. If a more permanent threshold installation is desired, lag bolts 53 can be inserted. Thus by using lag assembly 42, threshold 60 can be temporarily installed for quick removal or replacement as bushings 46 will hold threshold 60 in place without the need for lag bolts 53.

Garage door 40 is then closed and is contained within U-shaped member 11 providing a secure barrier against moisture and debris penetration. If the garage door is loose within the threshold sections used, overhead door 40 is raised and liners such as liner 15 in FIG. 1 are selected having a proper thickness and are inserted and adhered with a standard adhesive into each threshold section to provide a tighter fit between garage door 40 when closed and threshold assembly 60 to prevent water and debris penetration.

As would be understood installed threshold assembly 60 will prevent and repel surface leaves 35, water and other debris from entering garage 51. Further, threshold assembly 60 can be formed using any number of threshold sections 10, 20, 27 or 30 or alternatives thereof to provide an effective, impenetrable barrier against moisture, debris, leaves and the like.

The illustrations and examples provided herein are for explanatory purposes and are not intended to limit the scope of the appended claims.

I claim:

1. A threshold section in combination with an overhead door, said combination comprising: an elongated upright U-shaped member relative to said door, said U-shaped member comprising a base and a pair of parallel spaced apart upright sides, said sides each connected to said base, said sides and said base defining an open channel for selectively receiving said door therein, a pair of opposing downwardly depending flanges, each of said pair of flanges attached to different ones of said upright sides and extending outwardly therefrom, and each of said pair of flanges having a lateral width less than the vertical height of said U-shaped member such that said flanges do not contact a substrate therebeneath and form an opening along each side, wherein said pair of flanges and said upright sides define an exterior cavity for urging wind and debris away from said threshold section.

2. The threshold section of claim 1 wherein each of said pair of flanges extend at an acute angle relative to said U-shaped member.

3. The threshold section of claim 2 wherein each of said pair of flanges extend 30-60° relative to said U-shaped member.

4. The threshold section of claim 3 wherein said acute angle is about 40°.

5. The threshold section of claim 1 further comprising a brace, said brace contiguous to one of said pair of flanges.

6. The threshold section of claim 1 further comprising a plurality of braces, each of said plurality of braces contiguous to one of said pair of flanges.

7. The threshold section of claim 1 wherein said U-shaped member is formed from a rigid material.

8. The threshold section of claim 7 wherein said rigid material comprises a metal.

9. The threshold section of claim 7 wherein said rigid material comprises a polymeric material.

10. The threshold section of claim 1 comprising a fastener, wherein said U-shaped member further defines an aperture, said fastener contained within said aperture.

11. The threshold section of claim 10 wherein said fastener comprises a lag assembly.

12. The threshold section of claim 1 further comprising a seal, said seal affixed to said U-shaped member.

13. A threshold in combination with an overhead door comprising: a first threshold section, said first threshold section comprising an elongated rigid upright U-shaped member relative to said door, said U-shaped member comprising a base and a pair of parallel spaced upright sides, said sides each connected to said base, said sides and said base defining an open channel for selectively receiving said door therein, a pair of rigid flanges, each of said pair of flanges joined directly to different ones of said pair of upright sides, and each of said pair of flanges extending outwardly from said U-shaped member such that said flanges do not contact a substrate therebeneath, wherein said pair of flanges and said upright sides define an exterior cavity for urging wind and debris away from said threshold section, a second threshold section, said second threshold section joined to said first threshold section.

14. The threshold of claim 13 wherein said second threshold section includes an upright U-shaped member.

15. The threshold of claim 13 further comprising a seal, said seal comprising a resilient member, said seal attached to said first threshold section.

16. A threshold for an overhead door comprising: a threshold section, said threshold section comprising an elongated rigid U-shaped member with an upright opening, said U-shaped member comprising a base and a pair of parallel spaced upright sides, said sides each connected to said base, said sides and said base defining an open channel for selectively receiving said door therein, a pair of rigid flanges, each of said pair of flanges joined directly to different ones of said pair of upright sides, each of said pair of flanges extending outwardly from said U-shaped member such that said flanges do not contact a substrate therebeneath, wherein said pair of flanges and said upright sides define an exterior longitudinal cavity for urging wind and debris away from said threshold section, and a brace, said brace positioned on an exterior surface of one of said upright sides and contiguous to one of said pair of flanges.

17. The threshold section of claim 16 wherein said threshold section is formed from metal.

18. The threshold section of claim 16 wherein said threshold section is formed from a polymeric material.

19. The threshold section of claim 16 wherein each of said pair of flanges extend at an angle of about 40° relative to said U-shaped member.

* * * * *